US009748049B2

(12) United States Patent
Okazumi et al.

(10) Patent No.: US 9,748,049 B2
(45) Date of Patent: Aug. 29, 2017

(54) DEFORMABLE CONTACT HAVING A FLAT SURFACE AND A CURVED SURFACE OPPOSITE THE FLAT SURFACE

(75) Inventors: Takuro Okazumi, Shiga (JP); Kazumasa Seki, Shiga (JP)

(73) Assignee: OMRON Corporation, Kyoto (JP)

( * ) Notice: Subject to any disclaimer, the term of this patent is extended or adjusted under 35 U.S.C. 154(b) by 5 days.

(21) Appl. No.: 14/360,187

(22) PCT Filed: Mar. 14, 2012

(86) PCT No.: PCT/JP2012/056599

§ 371 (c)(1),
(2), (4) Date: Jul. 2, 2014

(87) PCT Pub. No.: WO2013/088753

PCT Pub. Date: Jun. 20, 2013

(65) Prior Publication Data

US 2014/0326588 A1 Nov. 6, 2014

(30) Foreign Application Priority Data

Dec. 15, 2011 (JP) ..... 2011-275011

(51) Int. Cl.
*H01H 1/06* (2006.01)
*H01H 1/36* (2006.01)
(Continued)

(52) U.S. Cl.
CPC ..... *H01H 1/06* (2013.01); *C25D 1/00* (2013.01); *C25D 1/04* (2013.01); *H01H 1/02* (2013.01); *H01H 1/36* (2013.01); *H01H 1/40* (2013.01); *H01H 1/44* (2013.01); *H01H 1/50* (2013.01); *H01H 11/04* (2013.01); *H01H 11/042* (2013.01); *H01H 11/06* (2013.01); *H01R 13/2428* (2013.01); *H01H 2203/036* (2013.01); *H01R 43/16* (2013.01)

(58) Field of Classification Search
CPC ..... H01H 1/44; H01H 1/242; H01H 1/245; H01H 21/24; H01H 2235/01; H01R 13/2428
USPC ..... 200/275, 276.1, 559; 439/700, 824
See application file for complete search history.

(56) References Cited

U.S. PATENT DOCUMENTS 6,072,139 A * 6/2000 Nakase ..... H01H 1/245 200/553
6,315,621 B1 * 11/2001 Natori ..... H01R 13/2428 439/862

(Continued)

FOREIGN PATENT DOCUMENTS

JP 55-9017 U 1/1980
JP 55-178929 A 12/1980

(Continued)

OTHER PUBLICATIONS

International Search Report for corresponding International Application No. PCT/JP2012/056599, mailed Jun. 12, 2012 (4 pages).

*Primary Examiner* — Vanessa Girardi
(74) *Attorney, Agent, or Firm* — Osha Liang LLP

(57) ABSTRACT

A contact has a flat surface and a side surface that is parallel to the flat surface. At least a part of the side surface is curved so as to swell. At least a part of the contact is able to be elastically deformed in parallel to the flat surface.

4 Claims, 15 Drawing Sheets

(51) Int. Cl.

| | |
|---|---|
| ***H01R 13/24*** | (2006.01) |
| ***C25D 1/00*** | (2006.01) |
| ***H01H 1/40*** | (2006.01) |
| ***H01H 1/50*** | (2006.01) |
| ***H01H 11/04*** | (2006.01) |
| ***C25D 1/04*** | (2006.01) |
| ***H01H 1/02*** | (2006.01) |
| ***H01H 1/44*** | (2006.01) |
| ***H01H 11/06*** | (2006.01) |
| *H01R 43/16* | (2006.01) |

(56) References Cited

U.S. PATENT DOCUMENTS

| | | | | |
|---|---|---|---|---|
| 7,556,503 | B2 * | 7/2009 | Vinther | H01R 12/714 439/515 |
| 2014/0227912 | A1 * | 8/2014 | Sakai | H01R 13/2428 439/700 |
| 2014/0295711 | A1 * | 10/2014 | Franz | H01R 13/2442 439/660 |

FOREIGN PATENT DOCUMENTS

| | | | |
|---|---|---|---|
| JP | 61-71934 | U | 5/1986 |
| JP | 3-130120 | U | 12/1991 |
| JP | 2002-134202 | A | 5/2002 |

* cited by examiner 61
70
66
62, 65
63a
63b
63

Fig. 8

| | | No.1A | No.1B | No.1C | No.1D | No.1E | No.1F |
|---|---|---|---|---|---|---|---|
| Composition of electrolytic solution | Ni (g／L) | 50 − 130 | 50 − 130 | 50 − 130 | 50 − 130 | 50 − 130 | 50 − 130 |
| | Co (g／L) | 9 − 42 | 9 − 42 | 9 − 42 | 9 − 42 | 9 − 42 | 9 − 42 |
| | Boric acid (g·L) | 20 − 40 | 20 − 40 | 20 − 40 | 20 − 40 | 20 − 40 | 20 − 40 |
| | Surfactant (g/L) | 0.18 − 4.5 | 0.18 − 4.5 | 0.18 − 4.5 | 0.18 − 4.5 | 0.18 − 4.5 | 0.18 − 4.5 |
| | Additive (g/L) | 0 | 0.01 | 0.1 | 1 | 2 | 10 |
| Electroforming condition | Current (A) | 14.4 | 14.4 | 14.4 | 14.4 | 14.4 | 14.4 |
| | Current density (A/dm$^2$) | 7.5 | 7.5 | 7.5 | 7.5 | 7.5 | 7.5 |
| Contact condition | Width D (μm) | 200 | 200 | 200 | 200 | 200 | 200 |
| | Height H (μm) | 200 | 200 | 200 | 200 | 200 | 200 |
| | Aspect ratio | 1 | 1 | 1 | 1 | 1 | 1 |

Fig. 11

| | | No.2A | No.2B | No.2C | No.2D | No.2E | No.2F | No.2G |
|---|---|---|---|---|---|---|---|---|
| Composition of electrolytic solution | Ni (g/L) | 50 — 130 | 50 — 130 | 50 — 130 | 50 — 130 | 50 — 130 | 50 — 130 | 50 — 130 |
| | Co (g/L) | 9 — 42 | 9 — 42 | 9 — 42 | 9 — 42 | 9 — 42 | 9 — 42 | 9 — 42 |
| | Boric acid (g·L) | 20 — 40 | 20 — 40 | 20 — 40 | 20 — 40 | 20 — 40 | 20 — 40 | 20 — 40 |
| | Surfactant (g/L) | 0.18 — 4.5 | 0.18 — 4.5 | 0.18 — 4.5 | 0.18 — 4.5 | 0.18 — 4.5 | 0.18 — 4.5 | 0.18 — 4.5 |
| | Additive (g/L) | 0.1 | 0.1 | 0.1 | 0.1 | 0.1 | 0.1 | 0.1 |
| Electroforming condition | Current (A) | 14.4 | 14.4 | 14.4 | 14.4 | 14.4 | 14.4 | 14.4 |
| | Current density (A/dm$^2$) | 7.5 | 7.5 | 7.5 | 7.5 | 7.5 | 7.5 | 7.5 |
| Contact condition | Width D (μm) | 100 | 150 | 200 | 250 | 300 | 500 | 1000 |
| | Height H (μm) | 200 | 200 | 200 | 200 | 200 | 200 | 200 |
| | Aspect ratio | 2 | 1.3333 | 1 | 0.8 | 0.6667 | 0.4 | 0.2 |

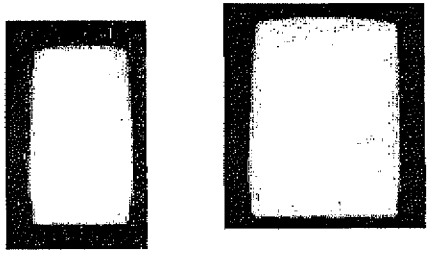
Fig. 12(A)
Fig. 12(B)
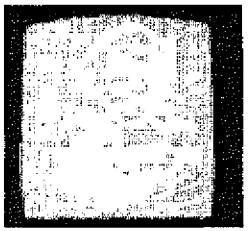
Fig. 12(C)
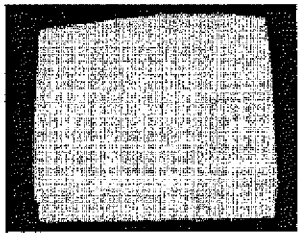
Fig. 12(D)
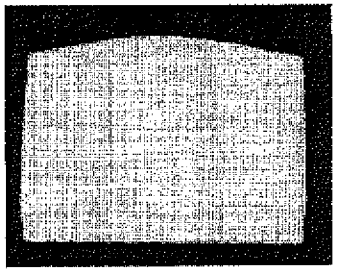
Fig. 12(E)
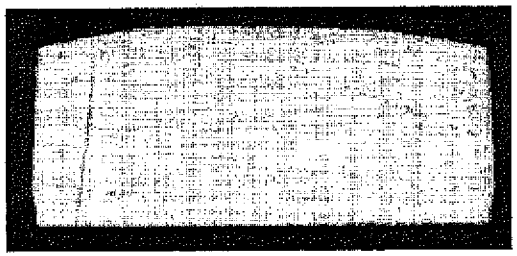
Fig. 12(F)
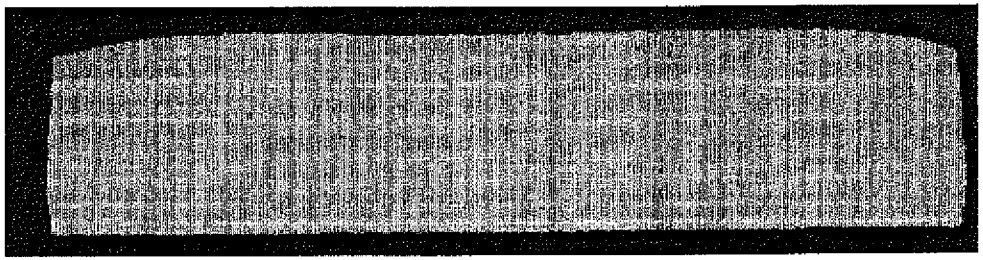
Fig. 12(G)

DEFORMABLE CONTACT HAVING A FLAT SURFACE AND A CURVED SURFACE OPPOSITE THE FLAT SURFACE

BACKGROUND

Technical Field

The present invention relates to a contact and a manufacturing method therefor, specifically to a contact used in a switch or a probe and a manufacturing method therefor.

Related Art

For example, Patent Document 1 discloses a contact that is elastically deformed in parallel with a flat surface perpendicular to a thickness direction. The contact is used in a socket. Referring to FIG. 1, in socket 11, contact 14 is accommodated in flattened empty chamber 13 formed in socket body 12. Contact 14 is formed by punching an elastic plate. Contact 14 includes contact points 16 and 17 at both ends of meandering portion 15. Contact points 16 and 17 of contact 14 accommodated in socket body 12 project from upper and lower surfaces of socket body 12. In socket 11, when coming into contact with a printed board, contact points 16 and 17 elastically compress meandering portion 15, and is retracted. When being not in contact with the printed board, contact points 16 and 17 project again by an elastic restoring force of meandering portion 15.

However, in the socket disclosed in Patent Document 1, both side surfaces of the contact are flatten to enlarge a contact area between the contact and a wall surface of the empty chamber. Therefore, friction between the contact and the wall surface of the empty chamber increases to prevent smooth motion during expansion and contraction of the contact. Particularly, when a burr of the punching remains at an edge of the contact, the burr is caught in the wall surface of the empty chamber to prevent the smooth motion during the expansion and contraction of the contact.

Because both the side surfaces of the contact of Patent Document 1 are flatten, the friction between the contact and the wall surface of the empty chamber increases during the expansion and contraction of the contact, and the contact is easy to abrade.

In the case that the plate-like contact having a uniform thickness has a structure in which the contact is press-fitted in an opening or a hole of a contact housing member, the edge of the opening or hole of the contact housing member is easily scraped by a corner of the contact.

PATENT DOCUMENTS

Patent Document 1: Japanese Unexamined Patent Publication No. 2002-134202

SUMMARY

One or more embodiments of the present invention provides a contact that can decrease the friction between the contact and the contact housing member and smoothly be deformed even if the contact is elastically deformed while being in contact with the contact housing member, and a manufacturing method therefor.

In accordance with one or more embodiments of the present invention, in a contact in which at least a part is configured to be able to be elastically deformed in parallel to a flat surface, at least a part of a side surface parallel to the flat surface of the contact is curved so as to swell.

In the contact according to one or more embodiments of the present invention, because at least the part of the side surface parallel to the surface in the direction in which the contact is elastically deformed is curved so as to swell, even if the side surface on the curved side is in contact with another member, the friction with another member can be reduced when the contact is elastically deformed, and the contact can smoothly elastically be deformed. The contact is hardly abraded because the friction with another member is reduced when the contact is elastically deformed. Because at least the part of the surface of the contact is curved so as to swell, even if the contact needs to be press-fitted in another member, the contact is inserted from the curved side surface side to facilitate press-fitting work, and another member is hardly scraped by the contact.

BRIEF DESCRIPTION OF THE DRAWINGS

FIG. 8 illustrates a condition of each sample when the contact is prepared while an additive concentration is changed.

FIG. 11 illustrates the condition of each sample when the contact is prepared when an aspect ratio of the section of the contact is changed.

FIGS. 12A to 12G illustrate the section of each sample prepared on the condition in FIG. 11.

DETAILED DESCRIPTION

Hereinafter, embodiments of the present invention will be described with reference to the accompanying drawings. However, the present invention is not limited to the following embodiments, but various design changes can be made without departing from the scope of the present invention. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

First Embodiment

Figure 1:
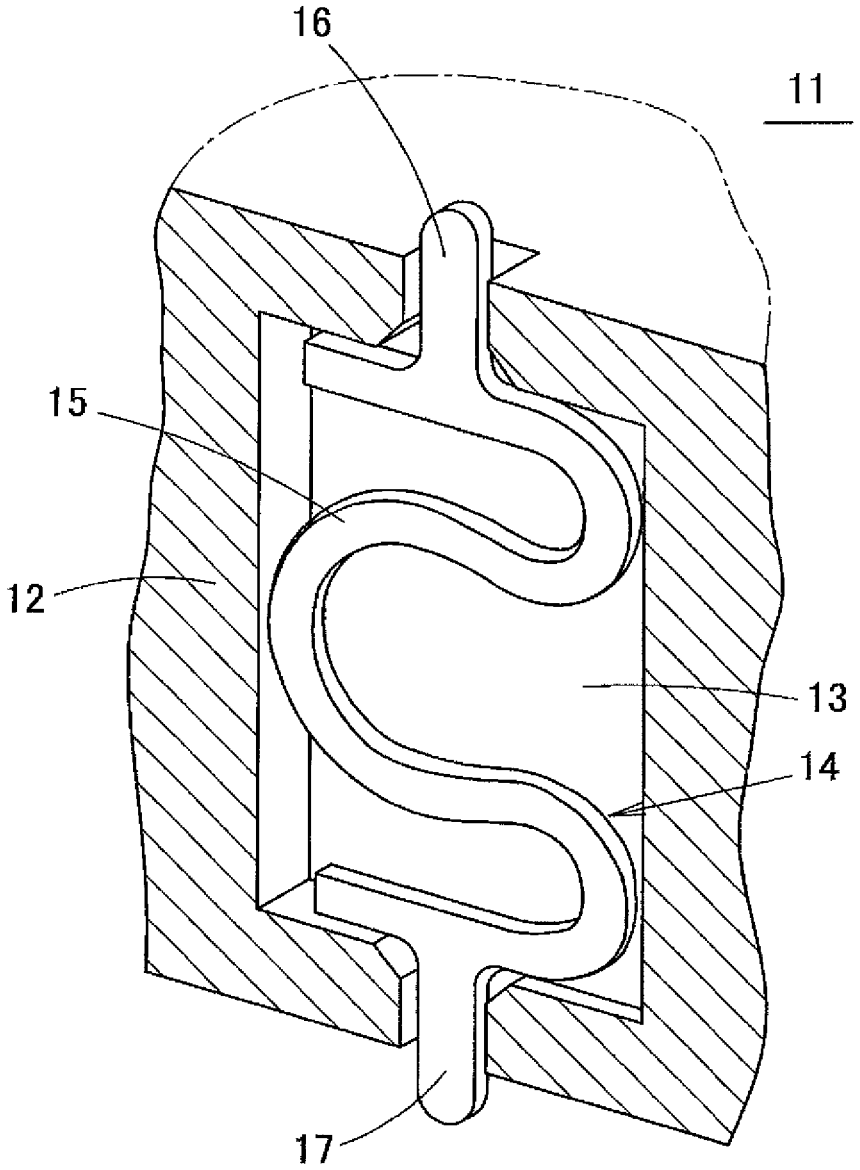
FIG. 1 is a perspective view illustrating a partially-broken socket disclosed in Patent Document 1.
Figure 2A:
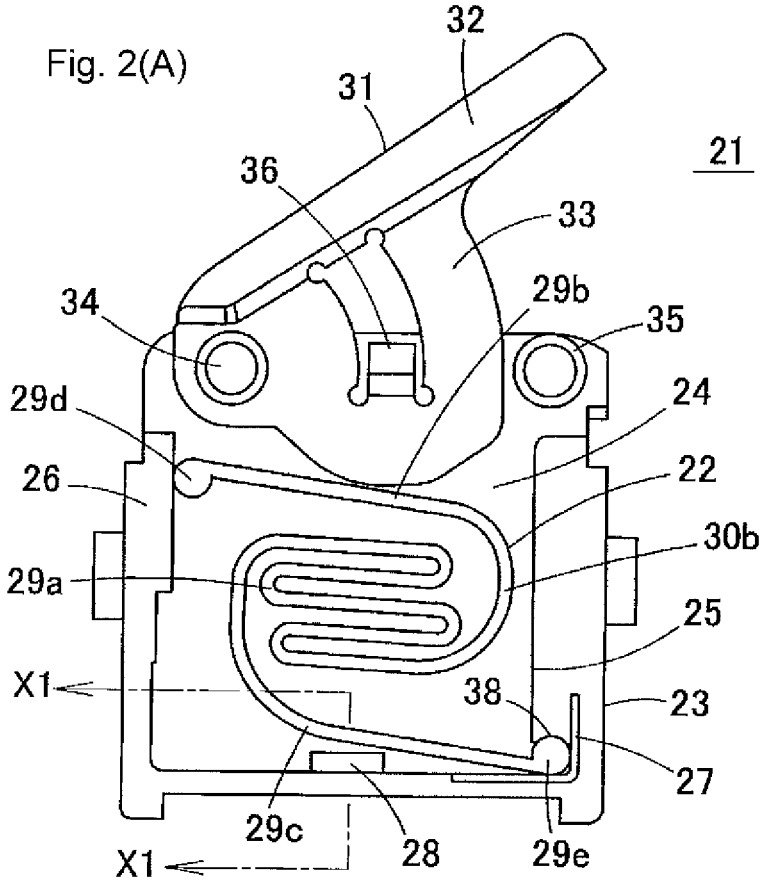
FIG. 2A is a side view illustrating an off state of a switch according to a first embodiment of the present invention.
Figure 2B:
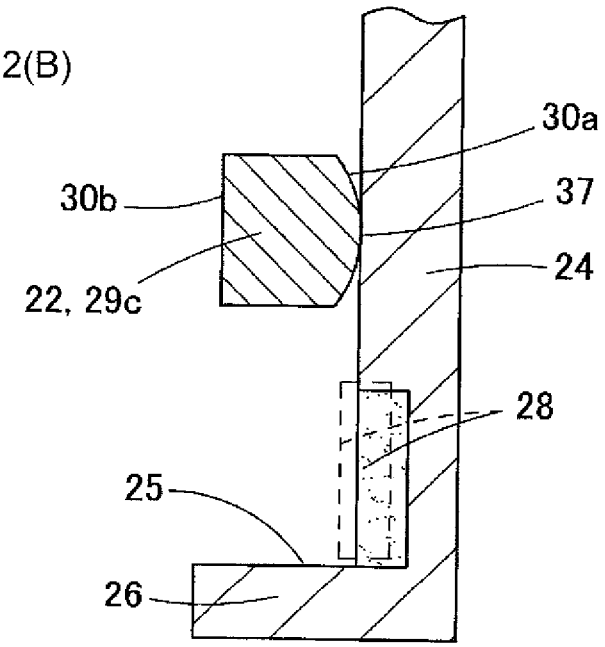
FIG. 2B is an enlarged sectional view taken on a line X1-X1 in FIG. 2A.
Figure 3A:
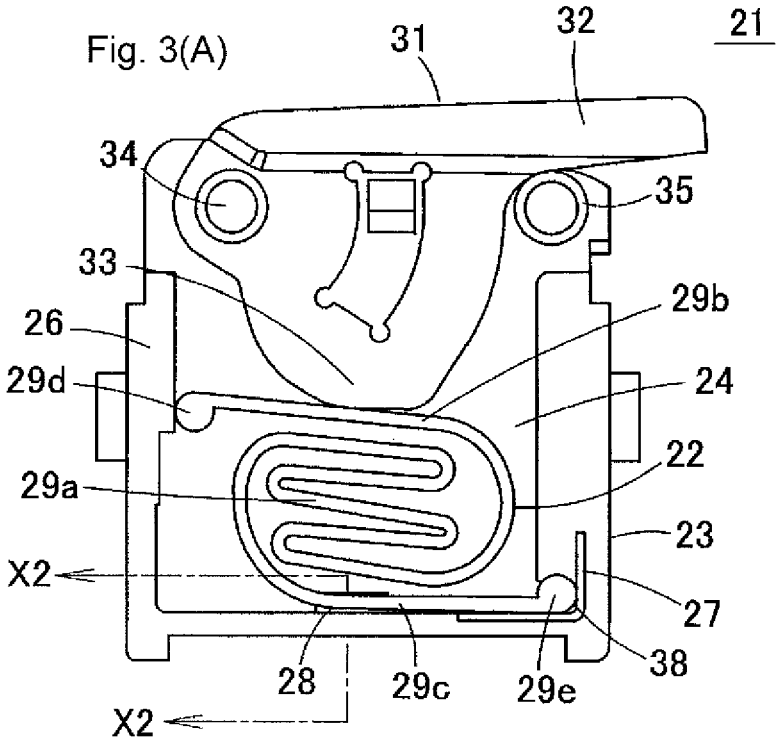
FIG. 3A is a side view illustrating an on state of the switch of the first embodiment.
Figure 3B:
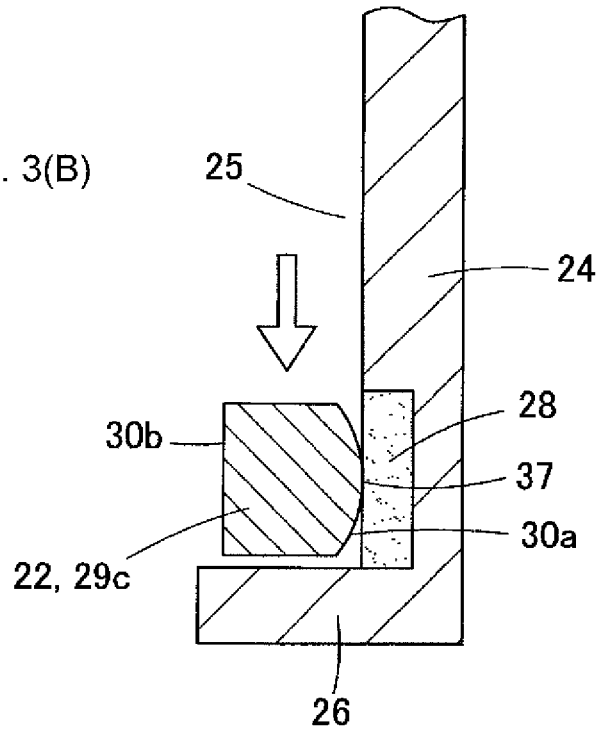
FIG. 3B is an enlarged sectional view taken on a line X2-X2 in FIG. 3A.
Figure 4A:
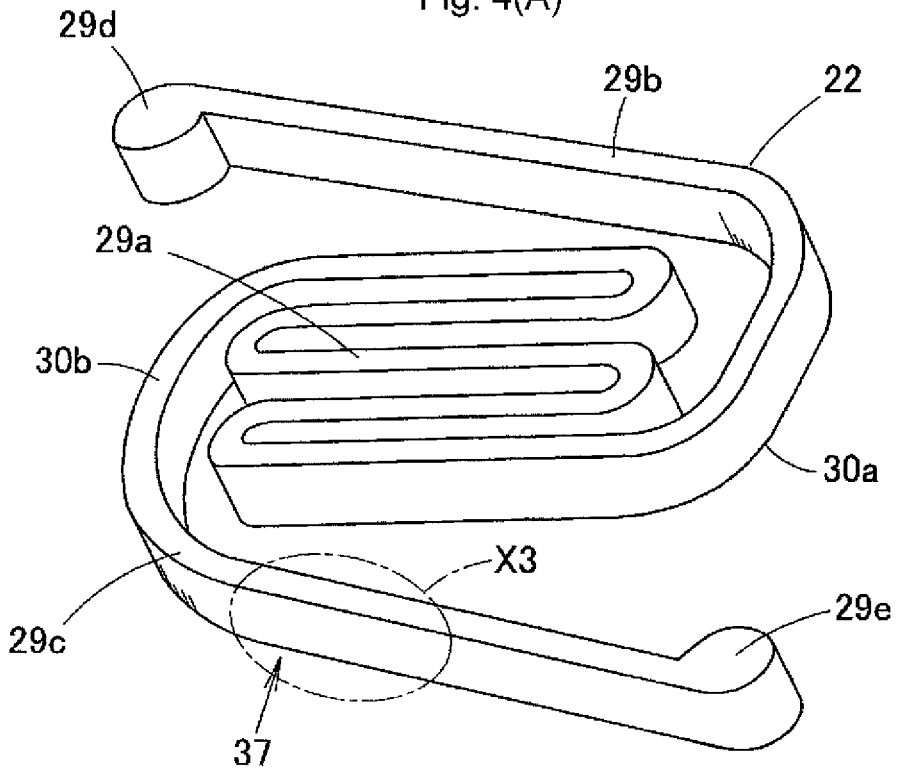
FIG. 4A is a perspective view illustrating a contact accommodated in the switch in FIGS. 2A and 3A.
Figure 4B:
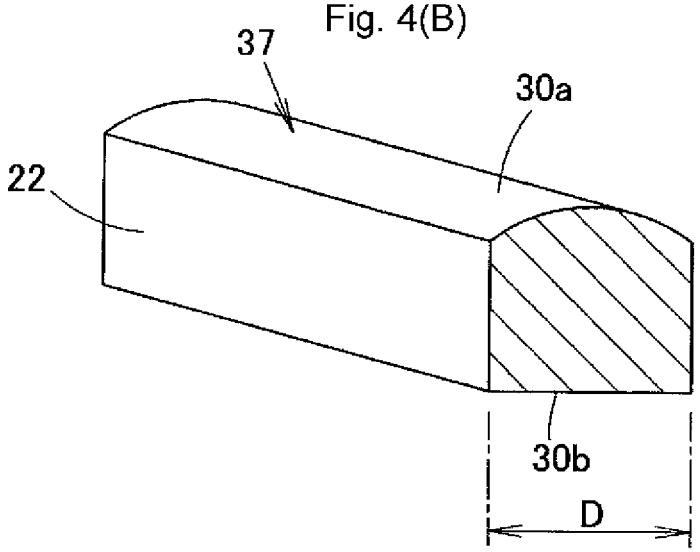
FIG. 4B is an enlarged perspective view of a portion X3 in FIG. 4A.

A structure of a contact device, namely, a switch according to a first embodiment of the present invention will be described below with reference to FIGS. 2A to 4B. FIG. 2A is a side view illustrating an off state of switch 21 of the first embodiment, and FIG. 2B is an enlarged sectional view taken on a line X1-X1 in FIG. 2A. FIG. 3A is a side view illustrating an on state of switch 21, and FIG. 3B is an enlarged sectional view taken on a line X2-X2 in FIG. 3A. FIG. 4A is a perspective view illustrating contact 22 accommodated in switch 21, and FIG. 4B is an enlarged perspective view (illustrating a vertically-inverted state) of a portion X3 in FIG. 4A.

As illustrated in FIGS. 2A and 3A, in switch 21, sheeted contact 22 (contactor) is accommodated in housing 23 that is of the contact housing member. Housing 23 includes shallow empty chamber 25 adjacent to a side surface of sidewall 24. A front edge, a rear edge, and a bottom surface of empty chamber 25 are surrounded by U-shape peripheral wall portion 26. Housing 23 is made of an insulating material such as a synthetic resin. Fitting hole 38 having a substantially cylindrical shape is made at one point in an inner corner portion of peripheral wall portion 26. In the bottom surface of peripheral wall portion 26, first electrode 27 bent into an L-shape is buried from a neighborhood of fitting hole 38 to the rear edge of peripheral wall portion 26 through a wall surface of fitting hole 38. Second electrode 28 is buried in a lower end of an inner surface of sidewall 24. First electrode 27 is buried so as not to generate a level difference with the bottom surface of peripheral wall portion 26, and second electrode 28 is also buried so as not to generate the level difference with the inner surface of sidewall 24.

Contact 22 is a spring having thin line width D ranging from tens of micrometer to hundreds of micrometer. Contact 22 is prepared by electroforming. As illustrated in FIG. 4A, contact 22 includes meandering portion 29*a* that is smoothly bent in a zig-zag manner, and extension portions 29*b* and 29*c* extend from both ends of meandering portion 29*a* so as to detour a periphery of meandering portion 29*a*. Substantially columnar contact end portions 29*d* and 29*e* are provided at ends of extension portion 29*b* and 29*c*, respectively. Contact 22 can elastically be bent in a plane parallel to a flat surface perpendicular to a thickness direction. On average, side surface 30*a* is parallel to the flat surface perpendicular to the thickness direction, and side surface 30*b* becomes a planar surface parallel to the flat surface perpendicular to the thickness direction. In side surface 30*a*, a section perpendicular to a length direction of each portion is smoothly curved such that a central portion swells, and an apex of each section extends along a line of contact 22. That is, in each portion except contact end portions 29*d* and 29*e* of contact 22, side surface 30*a* is formed into a cylindrical lens shape as illustrated in FIG. 4B. In contact end portions 29*d* and 29*e*, side surface 30*a* is formed into a dome shape. In the curved surface (side surface 30*a*) of extension portion 29*c*, a place corresponding to second electrode 28 constitutes contact point 37 that comes into contact with or separates from second electrode 28. A contact point material is not added to contact point 37, but contact point 37 is the simple curved surface.

As illustrated in FIGS. 2A and 2B, contact 22 is accommodated in empty chamber 25 such that side surface 30*a* including the curved surface is in contact with sidewall 24, and contact end portion 29*e* is press-fitted in fitting hole 38. Contact end portion 29*e* press-fitted in fitting hole 38 is in contact with first electrode 27 to maintain an electric connection relationship between contact end portion 29*e* and first electrode 27. Because contact end portion 29*e* is press-fitted in fitting hole 38 from side surface 30*a* curved into the dome shape, press-fitting work of contact end portion 29*e* can be facilitated when contact end portion 29*e* is press-fitted in fitting hole 38, and peripheral wall portion 26 (edge of fitting hole 38) is hardly scraped by contact end portion 29*e*. An opening in the side surface of housing 23 may be covered with a cover plate.

Operating portion 31 is turnably attached to an upper portion of the side surface of sidewall 24. Operating portion 31 includes lever 32 and cam 33, and cam 33 is provided in a lower surface of lever 32. A front end portion of cam 33 is turnably attached to sidewall 24 by support shaft 34, and operating portion 31 turns when a base end portion of lever 32 is vertically moved while grasped. A turning range of operating portion 31 is restricted by rotation angle control means 36. When lever 32 abuts on stopper 35, lever 32 is not lowered any more. An outer circumferential surface of cam 33 is in contact with an upper surface of extension portion 29*b* of contact 22. An outer circumferential shape of cam 33 is formed so as to vertically extend contact 22 as illustrated in FIG. 2A when lever 32 is pulled up, and the outer circumferential shape of earn 33 is formed so as to compress contact 22 as illustrated in FIG. 3A when lever 32 is pushed down. In the state in which lever 32 is pulled up while contact 22 is extended as illustrated in FIG. 2A, contact end portion 29*e* is in contact with first electrode 27, contact point 37 of contact 22 is separated from second electrode 28 as illustrated in FIG. 2B, and first electrode 27 and second electrode 28 are electrically insulated from each other to turn off switch 21. On the other hand, in the state in which lever 32 is pushed down while contact 22 is compressed as illustrated in FIG. 3A, contact end portion 29*e* is in contact with first electrode 27, contact point 37 of contact 22 is also in contact with second electrode 28 as illustrated in FIG. 3B, and first electrode 27 and second electrode 28 are electrically connected to each other to turn on switch 21.

In switch 21, because side surface 30*a* of contact 22 is curved, contact 22 and sidewall 24 of housing 23 are in line contact with each other to reduce a contact area. Therefore, the friction decreases when contact 22 expands and contracts (elastic deformation), and contact 22 can smoothly expand and contract. Because the friction between contact 22 and sidewall 24 also decrease, the abrasion between contact 22 and housing 23 is reduced to lengthen a lifetime of switch 21.

Only side surface 30*a* of contact 22 is curved, and front and rear surfaces (that is, side surface 30*a* or side surface 30*b*) of contact 22 can easily be distinguished from each other. Therefore, the front and rear surfaces of contact 22 can easily be distinguished from each other when contact 22 is assembled in housing 23. Particularly, when the shapes of the front and rear surfaces of contact 22 are confusingly similar to each other as illustrated in the drawings, there is a risk of mistaking the front and rear surfaces in setting a cassette or a tray, in which many contacts are accommodated. When only side surface 30*a* is curved, the front and rear surfaces of contact 22 can easily be distinguished from each other by a light reflection state and the like.

Because contact point 37 is curved side surface 30*a* of contact 22, contact point 37 comes into line contact with second electrode 28 or sidewall 24. Therefore, contact point 37 is hardly abraded due to the small contact area. Because a contact pressure of contact point 37 increases, contact point 37 slides on the surface of second electrode 28 as indicated by an arrow in FIG. 3B. Therefore, dirt or an oxide film on the surface of second electrode 28 can be scraped and a wiping effect of contact point 37 is enhanced.

Even if a level difference is generated at the edge of second electrode 28 because second electrode 28 projects from sidewall 24 illustrated by a broken line in FIG. 2B or a burr is generated at the edge of second electrode 28, contact point 37 does not stop at the level difference because contact point 37 (side surface 30*a*) is curved, but contact point 37 can clear the level difference to come into contact with second electrode 28.

Curved side surface 30*a* may partially be recessed to have at least two peaks. In this case, the contact area with housing 23 is enlarged to increase the friction. Desirably curved side surface 30*a* has one peak like a cylindrical lens shape. In curved side surface 30*a*, an apex may be located at the end of side surface 30*a*. In this case, the apex is easy to abrade. Desirably the apex is separated from the end of side surface 30*a*.

In the first embodiment, the cylindrical lens shape is described as an example of the curve. However, the curve is not limited to the cylindrical lens shape. Any smoothly-curved arc shape such as the dome shape may be used.

Second Embodiment

Figures 5A, 5B, 5C, 5D:
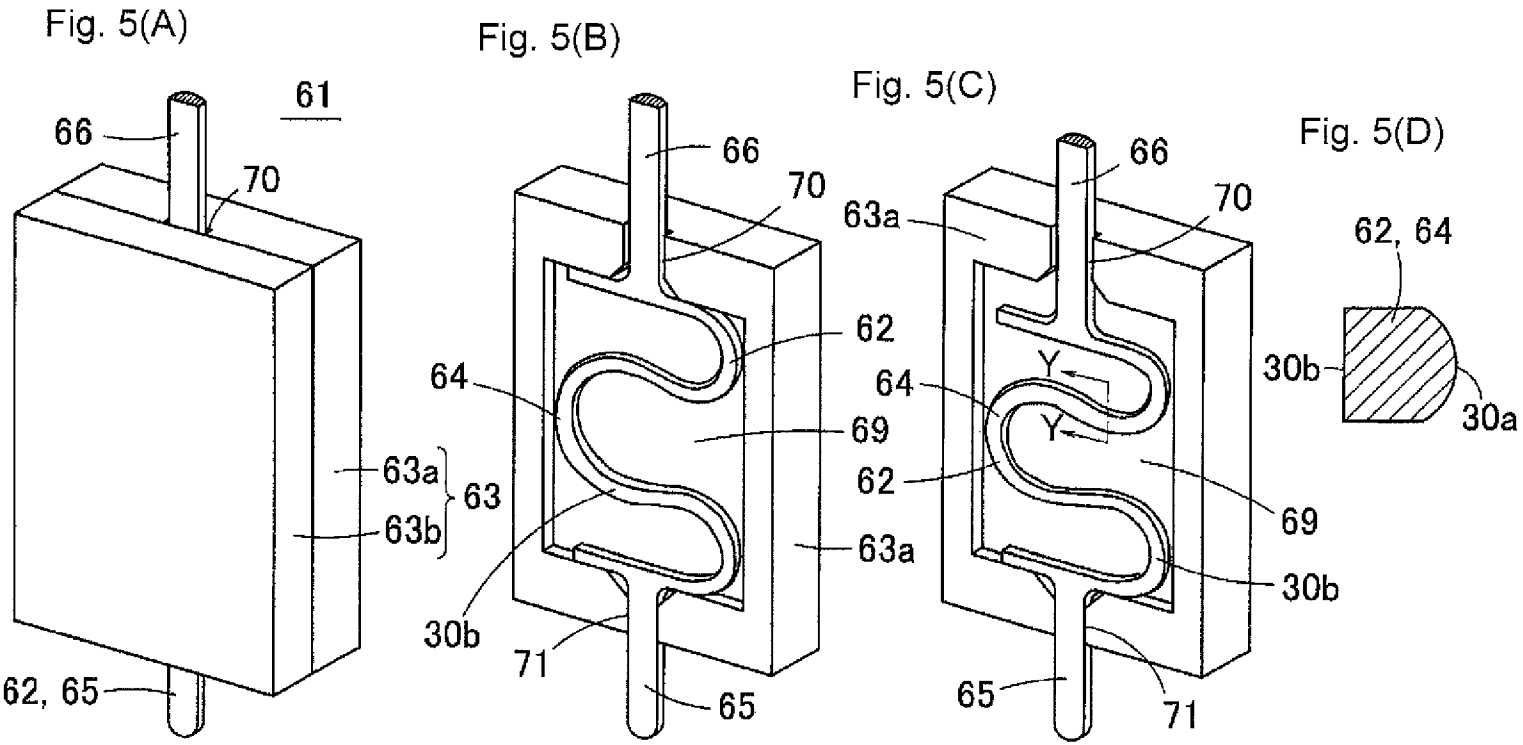
FIG. 5A is a perspective view illustrating a probe according to a second embodiment of the present invention.
FIG. 5B is a perspective view illustrating an inside of the probe when the contact extends.
FIG. 5C is a perspective view illustrating the inside of the probe when the contact is compressed.
FIG. 5D is a sectional view taken on a line Y-Y in FIG. 5C.

A contact device, namely, probe 61 according to a second embodiment of the present invention will be described below with reference to FIGS. 5A to 5D. FIG. 5A is a perspective view of probe 61, FIG. 5B is a perspective view illustrating an inside of probe 61 when contact 62 extends, FIG. 5C is a perspective view illustrating the inside of probe 61 when contact 62 is compressed, and FIG. 5D is a sectional view taken on a line Y-Y in FIG. 5C.

FIGS. 5A to 5C illustrate probe 61 that is used to inspect an electronic component. In probe 61, contact 62 is accommodated in housing 63. Housing 63 has a rectangular-solid outer shape. Housing 63 includes housing body 63*a* and cover 63*b*. As illustrated in FIGS. 5B and 5C, slit-like empty chamber 69 in which contact 62 is accommodated is provided in the inner surface of housing body 63*a*. Operating hole 70 communicating with empty chamber 69 is provided in the upper portion of housing body 63*a*, and press-fitting hole 71 communicating with empty chamber 69 is provided in the lower portion of housing body 63*a*. Empty chamber 69, operating hole 70, press-fitting hole 71 constitute spaces in each of which a depth is substantially equal to the thickness of contact 62.

Contact 62 is manufactured by the electroforming. Contact 62 includes meandering portion 64 that is smoothly bent in the zig-zag manner, contact point portion 65 that extends downward from the lower end of meandering portion 64, and movable portion 66 that extends upward from the upper end of meandering portion 64. As illustrated in FIG. 5D, in contact 62, side surface 30*a* is curved so as to swell, and side surface 30*b* constitutes the planar surface. That is, side surface 30*a* has the cylindrical lens-shape surface along length directions of meandering portion 64, contact point portion 65, and movable portion 66. Alternatively, side surface 30*b* is also curved such that the section swells, and side surfaces 30*a* and 30*b* may be formed into the cylindrical lens shape.

The width of press-fitting hole 71 is equal to the width of contact point portion 65. The width of operating hole 70 is slightly wider than the width of movable portion 66. In the case that contact 62 is assembled in housing body 63*a*, the upper end of contact point portion 65 is pushed in contact point portion 65 from the side of side surface 30A to fix contact point portion 65, and movable portion 66 is inserted in operating hole 70 to accommodate meandering portion 64 in empty chamber 69. At this point, contact point portion 65 is press-fitted in press-fitting hole 71 from side surface 30*a* curved into the cylindrical lens shape. Therefore, when contact point portion 65 is press-fitted in press-fitting hole 71, work to press-fit contact point portion 65 can easily be performed, and housing body 63*a* (edge of press-fitting hole 71) is hardly scraped by contact point portion 65. When contact 62 is assembled in housing body 63*a*, cover 63*b* is attached to housing body 63*a* to accommodate contact 62 in housing 63.

For example, in the case that an inspection is performed by bringing probe 61 into contact with a terminal of the electronic component, movable portion 66 is pushed down to bring contact point portion 65 into contact with the terminal of the electronic component. When movable portion 66 is further pushed down, meandering portion 64 is compressed to contract as illustrated in FIG. 5C, contact point portion 65 is brought into contact with the terminal at a proper pressure.

Because the thickness of empty chamber 69 is equal to the thickness of contact 62, a friction force is generated between the wall surface of empty chamber 69 and meandering portion 64 when meandering portion 64 expands and contracts. Additionally, because meandering portion 64 becomes small and thin when probe 61 is downsized, a spring characteristic of meandering portion 64 is weakened. Therefore, there is a risk that meandering portion 64 hardly expands when contact point portion 65 is separated from the terminal. However, because side surface 30*a* is curved in probe 61, the contact area between side surface 30*a* and the wall surface of empty chamber 69 is reduced to decrease the friction force, and meandering portion 64 can smoothly expand and contract. The abrasion of meandering portion 64 is also reduced.

In one or more of the above embodiments, the switch and the probe are described by way of example. However, one or more embodiments of the present invention can also be applied to contact devices such as a connector and a socket. The side surface 30*b* is an example of a first side surface that is a flat surface according to one or more embodiments of the present invention. The side surface 30*a* is an example of a second side surface that that a curved portion according to one or more embodiments of the present invention. The meandering portions 29*a*, 64 are examples of elastic deformation portions according to one or more embodiments of the present invention.

(Manufacturing Method)

A method for manufacturing the contact of the first and second embodiments by the electroforming will be described with reference to FIGS. 6A to 6J.

FIG. 6 illustrates a process of molding contact 81 (that is, contacts 22 and 62) by the electroforming. FIGS. 6A to 6F illustrate a process (mother die forming process) of forming mother die 82, FIGS. 6G and 6H illustrate a process (electrodeposition process) of preparing contact 81 by performing electrodeposition of metal in cavity 83, and FIGS. 6I and 6J illustrate a process (release process) of releasing contact 81 from mother die 82. Actually, plural cavities 83 are formed in mother die 82 to prepare plural contacts 81 at one time. For the sake of convenience, the case that one contact 81 is prepared will be described below.

Figure 6A:
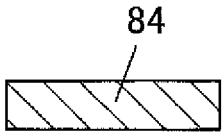
FIGS. 6A to 6J are schematic sectional views illustrating a process of manufacturing the contact according to one or more embodiments of the present invention.
Figure 6B:
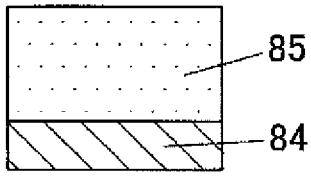
Figure 6C:
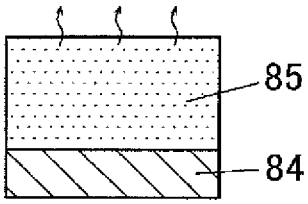
Figure 6D:
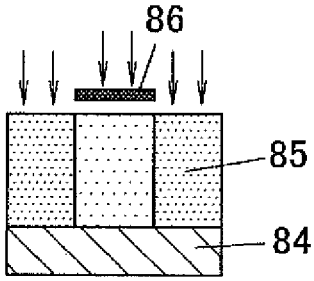
Figure 6E:
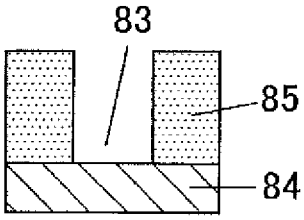
Figure 6F:
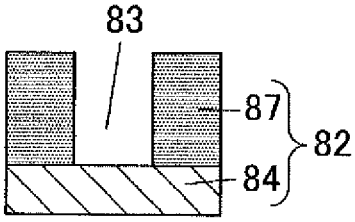

Referring to FIG. 6A, at least the planar upper surface of metallic conductive base material 84 is subjected to a treatment in order to easily release electrodeposited contact 81. In the mother die forming process, as illustrated in FIG. 6B, negative photoresist 85 is applied to the upper surface of conductive base material 84 to form a thick film having the uniform thickness using a spray coater or a spin coater. After photoresist 85 is prebaked as illustrated in FIG. 6C, photoresist 85 is exposed while a region where cavity 83 is formed is covered with mask 86 as illustrated in FIG. 6D. The exposed region of photoresist 85 is not dissolved during development because of insolubilization, only the region covered with mask 86 is dissolved and removed by the development, and cavity 83 is formed in photoresist 85 as illustrated in FIG. 6E. Conductive base material 84 is exposed from the bottom surface of cavity 83. Finally, photoresist 85 is post-baked to form insulating layer 87 having the predetermined thickness on the upper surface of conductive base material 84. FIG. 6F illustrates the obtained mother die 82.

In FIG. 6, only the upper surface of conductive base material 84 is covered with insulating layer 87. Actually, the lower surface and the side surface of conductive base material 84 are also covered with the insulating layer such that the metal is not electrodeposited on the region except the inside of cavity 83.

Figure 6G:
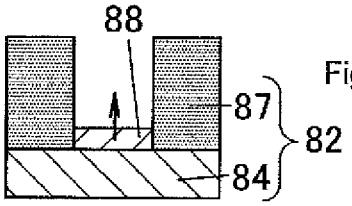
Figure 7:
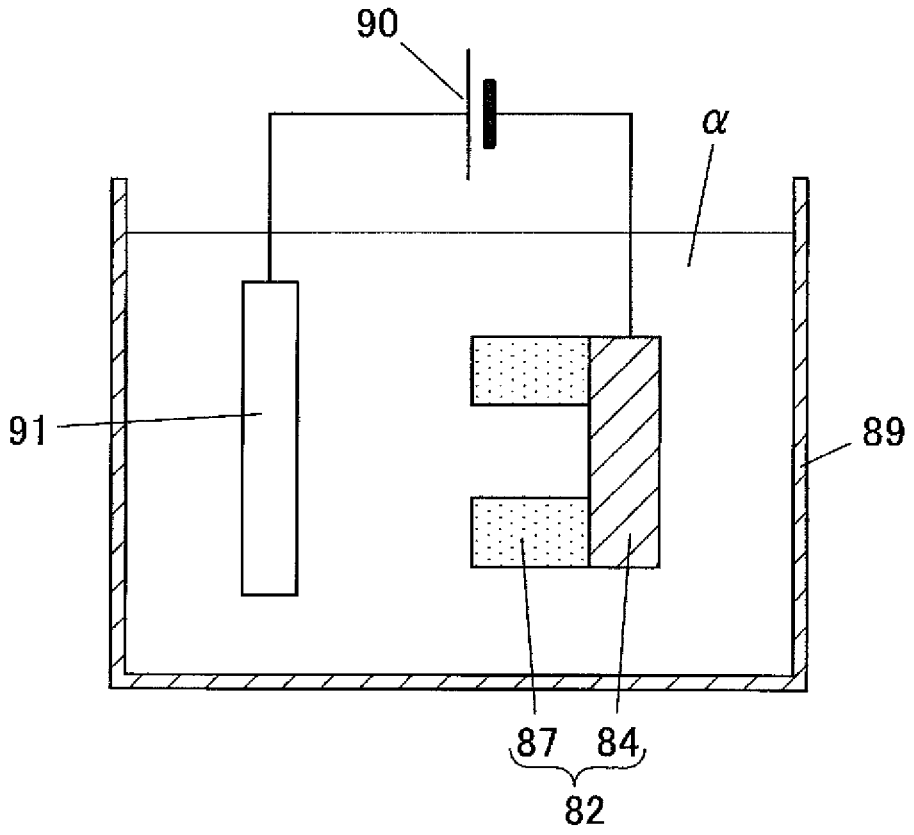
FIG. 7 is a sectional view illustrating a mother die put in an electrolytic bath.

In the electrodeposition process as illustrated in FIG. 7, mother die 82 is arranged in electrolytic bath 89, and DC power supply 90 applies a voltage between mother die 82 and counter electrode 91 to pass a current through electrolytic solution α. An additive containing sulfur (S) as a constituent element is added to electrolytic solution α. For example, saccharine sodium ($C_7H_4NO_3SNa$) is used as the additive. When the passage of the current is started, a metallic ion in electrolytic solution α is electrodeposited on the surface of conductive base material 84 to deposit metallic layer 88. On the other hand, because insulating layer 87 blocks the current, even if the voltage is applied between mother die 82 and counter electrode 91, the metal is not directly electrodeposited on insulating layer 87. Therefore, as illustrated in FIG. 6G, metallic layer 88 is grown in a voltage application direction from the bottom surface in the cavity 83.

When the additive containing sulfur is added to electrolytic solution α, the current is hardly passed along the inner wall surface of cavity 83, and the current is easily passed through the central portion of cavity 83. As a result, a deposition rate of metallic layer 88 increases in the central portion of cavity 83, the deposition rate of metallic layer 88 decreases in the neighborhood of the inner wall surface of cavity 83, and the surface of metallic layer 88 grown in cavity 83 is curved such that the central portion of metallic layer 88 swells.

Figure 6H:
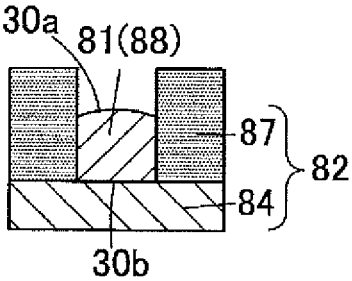

The thickness of electrodeposited metallic layer 88 (contact 81) is managed by an accumulated current conduction amount. When the target thickness of metallic layer 88 is detected by monitoring the accumulated current conduction amount, DC power supply 90 is turned off to stop the current. As a result, as illustrated in FIG. 6H, contact 81 is molded in cavity 83 by metallic layer 88 having the desired thickness.

Figure 6I:
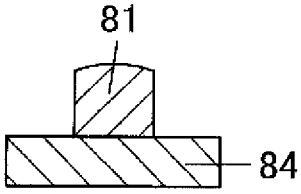
Figure 6J:
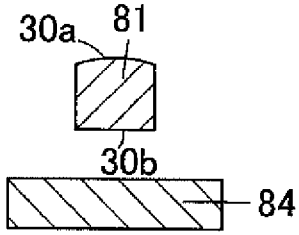

When contact 81 is molded, insulating layer 87 is dissolved or released as illustrated in FIG. 6I, and contact 81 is released from conductive base material 84 to obtain contact 81 in which the shape of mother die 82 is inversely transferred as illustrated in FIG. 6J.

In the manufacturing method, thick insulating layer 87 is formed so as to overlap the upper surface of conductive base material 84, and insulating layer 87 is opened to form cavity 83 in mother die 82. Therefore, fine cavity 83 can precisely be prepared using photolithography, and contact 81 can finely and precisely be prepared by the electroforming. Side surface 30*a* (the upper surface in the deposition direction in the cavity) of contact 81 can be curved by adding the additive containing sulfur as the constituent element to electrolytic solution α.

Pressing may be used as the method of curving the side surface of contact 81. However, because the pressing is crushing, precise outer size and plate thickness are hardly controlled. On the other hand, in the electroforming, the whole of side surface 30*a* of contact 81 can be curved, and the outer size can precisely be controlled.

As illustrated in FIG. 6F, when conductive base material 84 exposed into cavity 83 is etched and recessed into the curved shape after cavity 83 is formed in insulating layer 87, side surfaces 30*a* and 30*b* can be curved.

An optimum ratio of the additive used to curve the side surface of the contact will be described below. In order to check the optimum ratio of the additive added to the electrolytic solution, the inventors prepared electrolytic solutions (electrolytic solution having density of 1110 g/L) having compositions indicated by sample Nos. 1A to 1F of FIG. 8. The electrolytic solution contains Ni, Co, boric acid, a surfactant, and the additive. FIG. 8 illustrates a mass of each component in the electrolytic solution of 1 liter, namely, a concentration of each component. Particularly, the sample No. 1A has the additive concentration (g/L) of 0 g/L (with no additive), the sample No. 1B has the additive concentration of 0.01 g/L, the sample No. 1C has the additive concentration of 0.1 g/L, the sample No. 1D has the additive concentration of 1 g/L, the sample No. 1E has the additive concentration of 2 g/L, and the sample No. 1F has the additive concentration of 10 g/L. The additive is saccharine sodium (sulfur content of 15.63 wt %). The metallic layer was deposited to prepare the contact on the same electroforming condition (see FIG. 8) using the electrolytic solutions. Contact β of the sample Nos. 1A to 1F prepared by the electroforming includes a patter section having width D of 200 μm, height H of 200 μm (aspect ratio of 1) as illustrated in FIG. 9G.

Figure 9A:
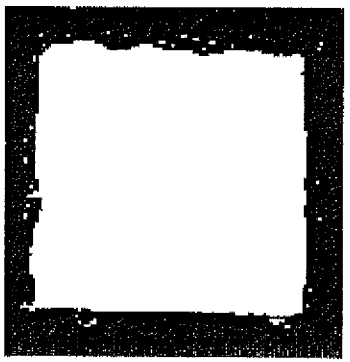
FIGS. 9A to 9F illustrate a section of each sample prepared on the condition in FIG. 8.
Figure 9B:
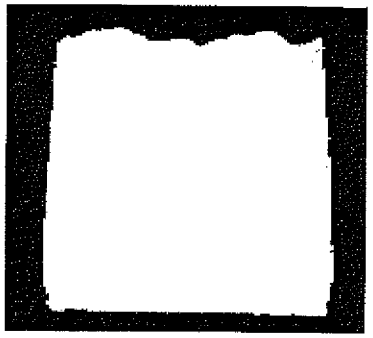
Figure 9C:
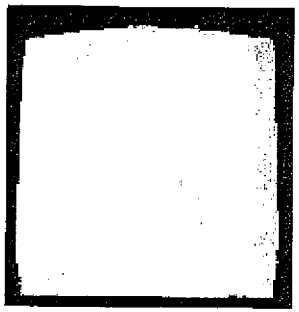
Figure 9D:
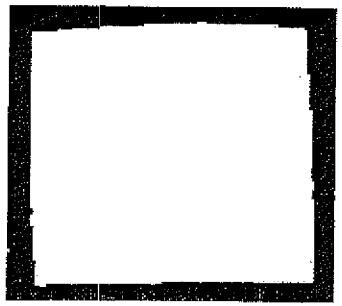
Figure 9E:
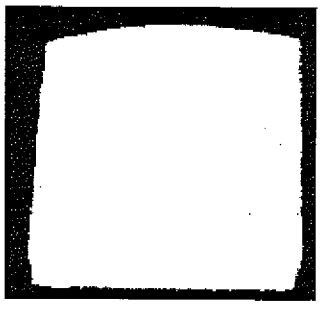
Figure 9F:
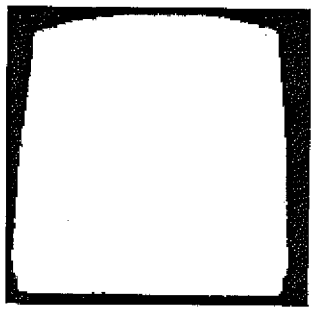
Figure 9G:
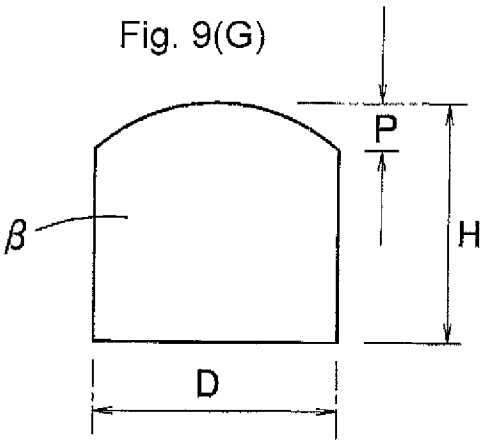
FIG. 9G is a view illustrating definitions of a width and a height in the section of the contact and a height of a curved surface.

FIGS. 9A to 9F are microscope photographs illustrating the sectional shapes of the contacts of the sample Nos. 1A to 1F prepared by the electroforming on the condition in FIG. 8. FIG. 9A illustrates the section of the deposited metallic layer of the sample No. 1A in the case that the additive concentration of the electrolytic solution is 0 g/L (with no additive). FIG. 9B illustrates the section of the deposited metallic layer of the sample No. 1B in the case that the additive concentration is 0.01 g/L (the sulfur concentration of the electrolytic solution is 0.0016 g/L). FIG. 9C illustrates the section of the deposited metallic layer of the sample No. 1C in the case that the additive concentration is 0.1 g/L (the sulfur concentration is 0.0156 g/L). FIG. 9D illustrates the section of the deposited metallic layer of the sample No. 1D in the case that the additive concentration is 1 g/L (the sulfur concentration is 0.1563 g/L). FIG. 9E illustrates the section of the deposited metallic layer of the sample No. 1E in the case that the additive concentration is 2 g/L (the sulfur concentration is 0.3126 g/L). FIG. 9F illustrates the section of the deposited metallic layer of the sample No. 1F in the case that the additive concentration is 10 g/L (the sulfur concentration is 1.563 g/L).

As can be seen from FIGS. 9C to 9F, the surface of the metallic layer is smoothly curved when the additive concentration of the electrolytic solution is greater than or equal to 0.1 g/L. On the other hand, as illustrated in FIGS. 9A and 9B, the surface of the metallic layer is coarsened to be hardly used as the contact when the additive concentration is less than or equal to 0.01 g/L. In the case in FIG. 9B, the width and the height of the metallic layer were 200 μm, a maximum height difference of surface irregularity was about 15 μm, arithmetic mean roughness Ra was 1.1868 μm, and maximum roughness Rz was 5.35354 μm. The case in FIG. 9A is substantially equal to the case in FIG. 9B in the roughness.

Therefore, in order to smoothly form the side surface of the contact, it is found that the additive concentration of the electrolytic solution is greater than or equal to 0.1 g/L.

Figure 10:
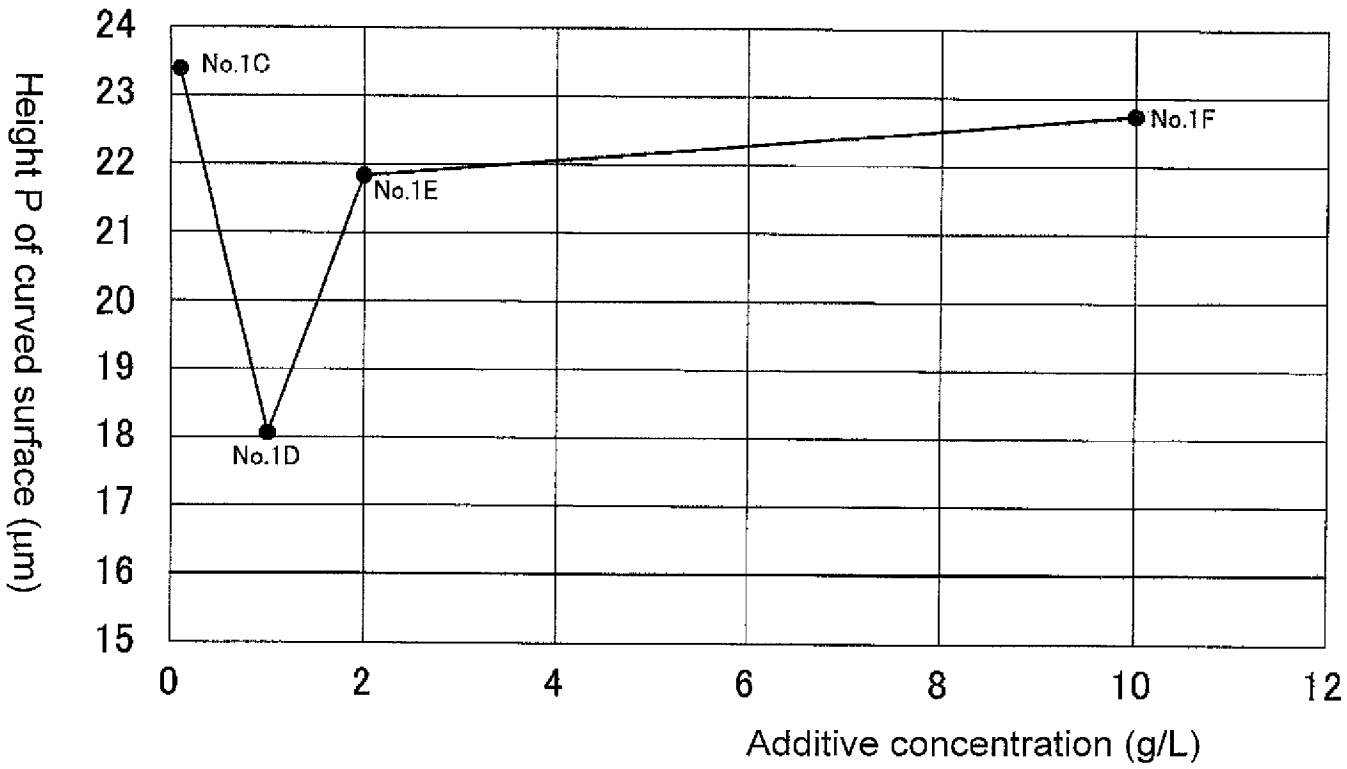
FIG. 10 is a view illustrating a relationship between the additive concentration and the height of the curved surface.

The curved surfaces of the sample Nos. 1C to 1F in which the additive concentration of the electrolytic solution was greater than or equal to 0.1 g/L had heights P (see FIG. 9G) of 23 μm, 18 μm, 22 μm, and 23 μm, respectively. FIG. 10 is a graph illustrating the result. In FIG. 10, a horizontal axis indicates the additive concentration, and a vertical axis indicates the height P of the curved surface.

In the switch 21 of the first embodiment, when second electrode 28 is buried in sidewall 24, second electrode 28 projects from sidewall 24 to generate the level difference at the end of second electrode 28 due to curing shrinkage of synthetic resin sidewall 24 or the generation of the burr as illustrated in FIG. 2B. The level difference of about 3 μm to about 15 μm is inevitably generated even if second electrode 28 is buried in sidewall 24 such that the surface of second electrode 28 is flush with the surface of sidewall 24. Therefore, in order that contact point 37 clears second electrode 28 even if the level difference of about 3 μm to about 15 μm is generated, it is necessary that the curved surface have height P of at least 16 μm at contact point 37 (side surface 30*a*).

Referring to FIG. 10, the curved surface has height P of at least 18 μm when the additive concentration is greater than or equal to 0.1 g/L. Therefore, when the additive concentration of the electrolytic solution is greater than or equal to 0.1 g/L (this corresponds to the sulfur concentration of at least 0.0156 g/L in the electrolytic solution), the side surface of the contact is smoothly curved, and the contact point provided in the curved surface is slid to be able to be more securely brought into contact with the electrode.

As is clear from FIGS. 9C to 9F, the curvature of the curved surface of the contact can be changed by changing the additive (or sulfur) concentration of the electrolytic solution within the range.

A relationship between the aspect ratio of the sectional shape of the contact and the curved surface was checked. In the sample No. 1C of FIG. 8, the additive concentration of the electrolytic solution is fixed to 0.1 g/L, aspect ratio H/D of the section of the contact was changed from 2.0 to 0.2. At this point, as illustrated in FIG. 9G, H is the height of the contact and D is the width of the contact. FIG. 11 illustrates the composition of the electrolytic solution (electrolytic solution having density of 1110 g/L) and the electroforming condition. The additive is saccharine sodium (sulfur content of 15.63 wt %). Height H of each contact was set to 200 μm, and the aspect ratio was changed by changing width D of the contact. In a sample No. 2A, width D was set to 100 μm, and aspect ratio H/D was set to 2. In a sample No. 2B, width D was set to 150 μm, and aspect ratio H/D was set to 1.3333. In a sample No. 2C, width D was set to 200 μm, and aspect ratio H/D was set to 1. In a sample No. 2D, width D was set to 250 μm, and aspect ratio H/D was set to 0.8. In a sample No. 2E, width D was set to 300 μm, and aspect ratio H/D was set to 0.6667. In a sample No. 2F, width D was set to 500 μm, and aspect ratio H/D was set to 0.4. In a sample No. 2G, width D was set to 1000 μm, and aspect ratio H/D was set to 0.2. The metallic layer was deposited to prepare the contact of each sample under the conditions.

Figure 13:
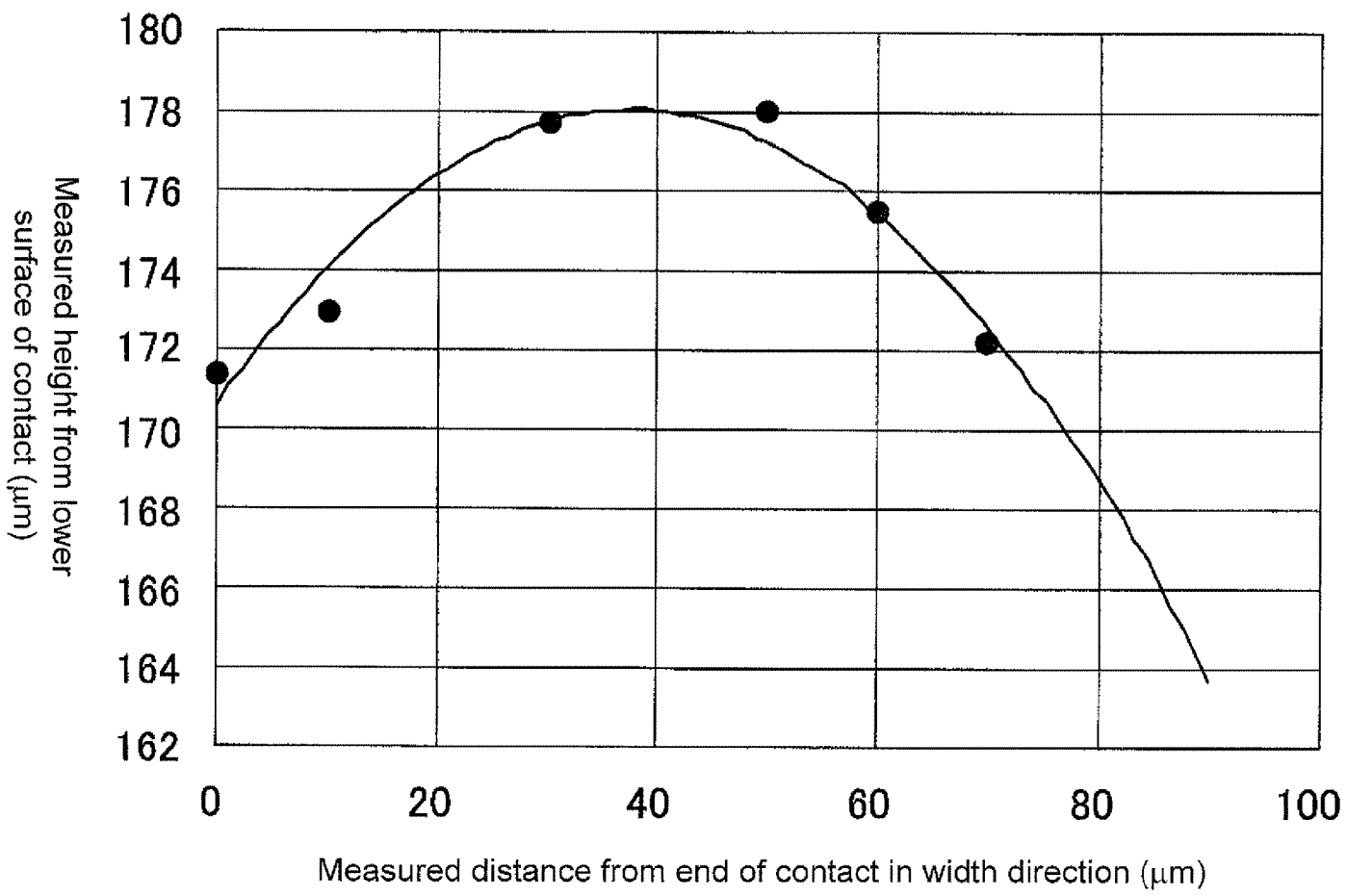
FIG. 13 is a view illustrating a shape of the curved surface of the contact in FIG. 12A.
Figure 14:
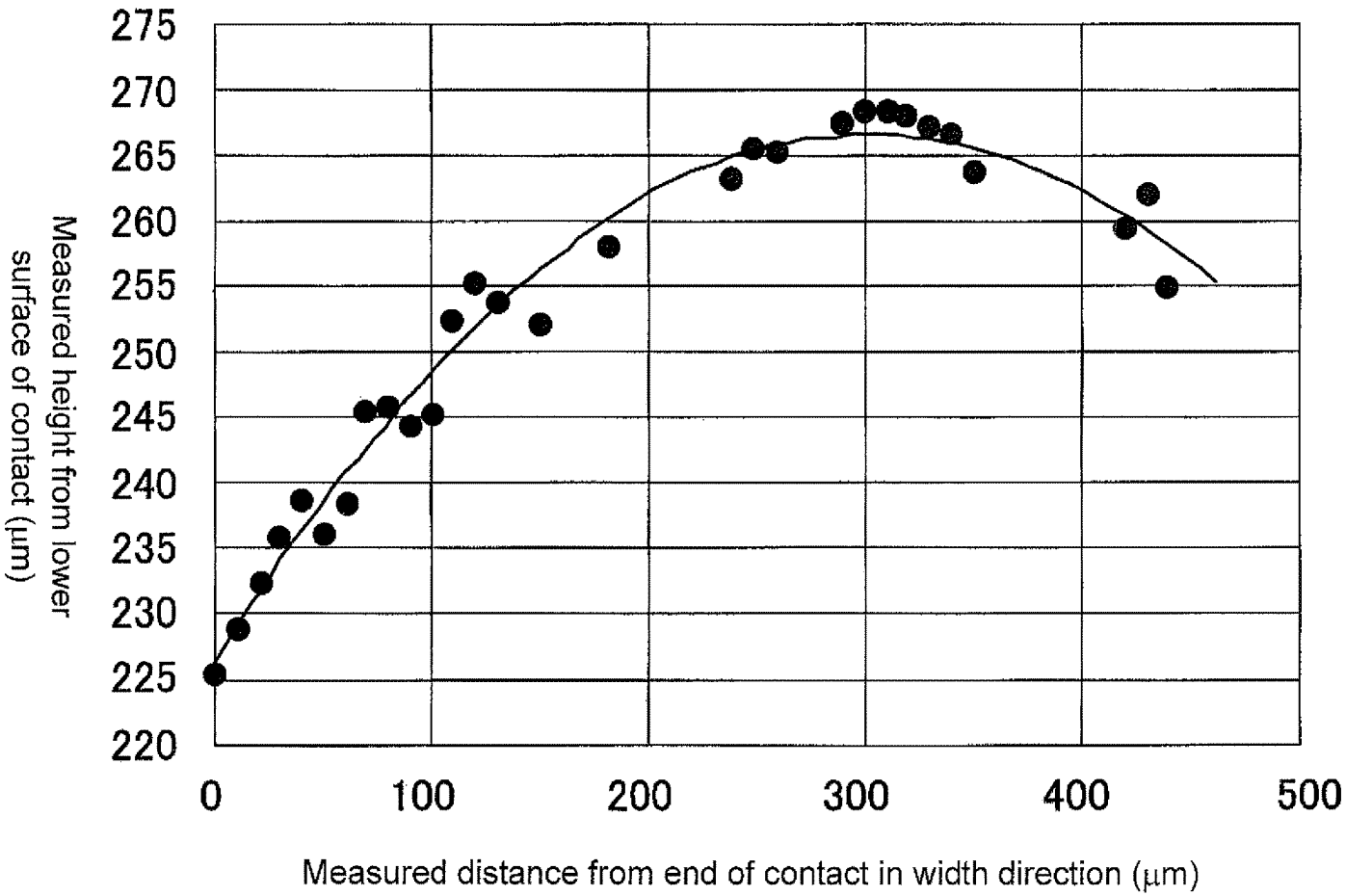
FIG. 14 is a view illustrating the shape of the curved surface of the contact in FIG. 12F.
Figure 15:
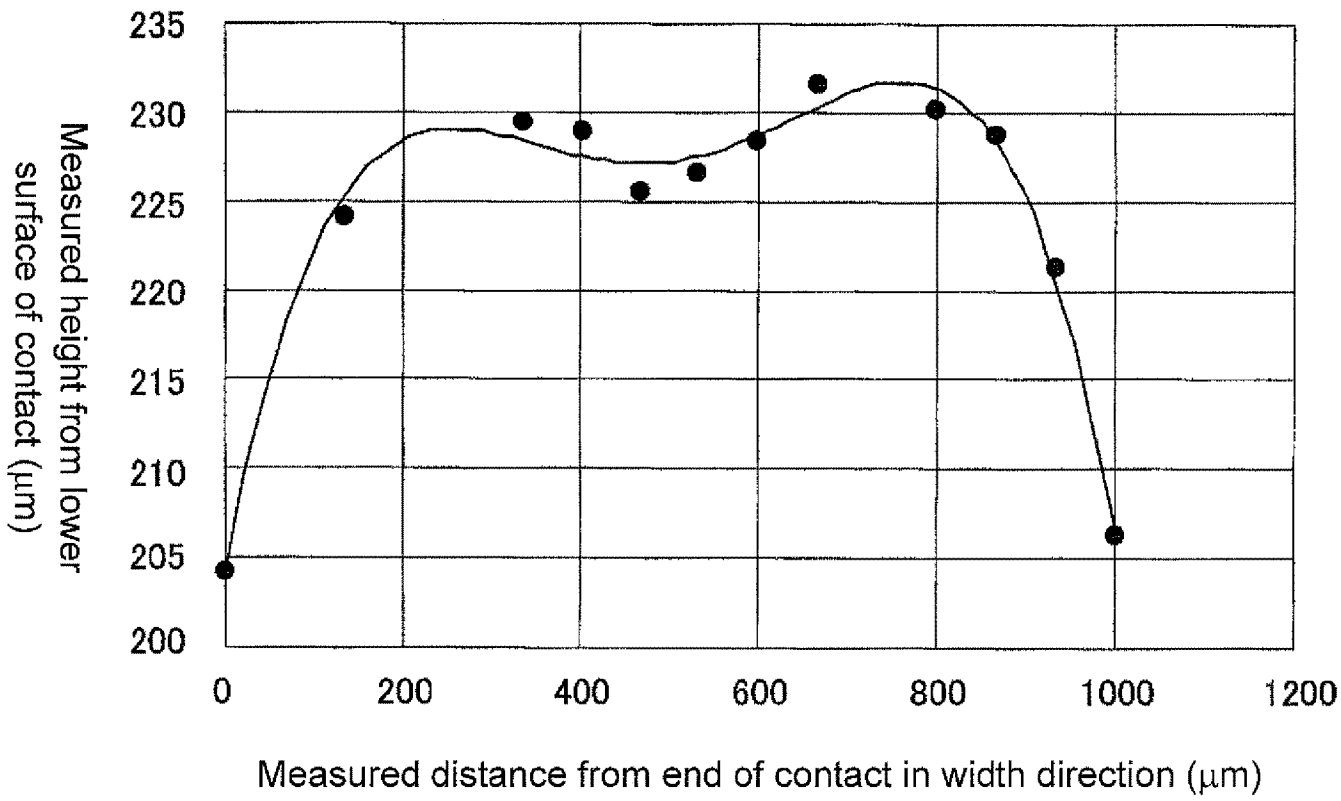
FIG. 15 is a view illustrating the shape of the curved surface of the contact in FIG. 12G.

FIGS. 12A to 12G are microscope photographs illustrating the sectional shapes of the contacts (metallic layer) of the sample Nos. 2A to 2G prepared by the electroforming on the condition in FIG. 11. FIG. 12A illustrates the section of the sample No. 2A having the aspect ratio of 2. FIG. 12B illustrates the section of the sample No. 2B having the aspect ratio of 1.3333. FIG. 12C illustrates the section of the sample No. 2C having the aspect ratio of 1. FIG. 12D illustrates the section of the sample No. 2D having the aspect ratio of 0.8. FIG. 12E illustrates the section of the sample No. 2E having the aspect ratio of 0.6667. FIG. 12F illustrates the section of the sample No. 2F having the aspect ratio of 0.4. FIG. 12G illustrates the section of the sample No. 2G having the aspect ratio of 0.2. FIG. 13 illustrates a profile of the curved surface (upper surface) of the sample No. 2A. FIG. 14 illustrating the profile of the curved surface (upper surface) of the sample No. 2F. FIG. 15 illustrates the profile of the curved surface (upper surface) of the sample No. 2G.

As can be seen from FIGS. 12C to 12F, 13, and 14, when the aspect ratio of the contact is greater than or equal to 0.4, the curved surface of the contact has one peak, but the recess is not generated. On the other hand, as can be seen from FIGS. 12G and 15, when the aspect ratio of the contact becomes 0.2, the curved surface of the contact has two peaks, and the recess is generated in the central portion. When the curved surface of the contact has the two peaks, the contact area of the contact is enlarged to generate troubles such that the effect to reduce the friction or abrasion is lost and such that dirt is accumulated in the recess to degrade contact reliability. Accordingly, the aspect ratio H/D of the contact is desirably greater than or equal to 0.4 in the section perpendicular to the length direction of the contact.

As is clear from FIGS. 12A to 12F, a curvature of the curved surface of the contact is changed by changing the aspect ratio H/D of the section of the contact within this range.

In the above embodiments, the section of the contact has the substantially rectangular shape. Alternatively, the section of the contact may have a substantially trapezoidal shape.

As described above, in a contact according to one or more embodiments of the present invention in which at least a part is configured to be able to be elastically deformed in parallel to a flat surface, at least a part of a side surface parallel to the flat surface of the contact is curved so as to swell.

In the contact according to one or more embodiments of the present invention, one of two side surfaces is curved so as to swell, the side surfaces being parallel to the flat surface and located on sides opposite to each other. Accordingly, because the front and rear surfaces of the contact are easily distinguished from each other, the front and rear surfaces are hardly mistaken in assembling the contact in the contact housing member.

In the contact according to one or more embodiments of the present invention, the other of the two side surfaces is flattened, the side surfaces being parallel to the flat surface and located on sides opposite to each other. Accordingly, it is only necessary to form the curve in one of the surfaces. Accordingly, the contact is easy to manufacture.

The contact according to one or more embodiments of the present invention includes an elastic deformation portion that is elongated when viewed from a direction perpendicular to the flat surface. In the contact, a side surface parallel to the flat surface of the elastic deformation portion is curved so as to swell in a section perpendicular to the direction in which the elastic deformation portion is elongated. Accordingly, because the surface is curved along the direction in which the elastic deformation portion extends, a contact area with another member is reduced along a length direction of the elastic deformation portion, and an effect to reduce the friction and abrasion can be enhanced.

In the contact according to one or more embodiments of the present invention, the side surface that is curved so as to swell is continuously formed along the direction in which the elastic deformation portion is elongated. Accordingly, because the friction between the curved side surface of the contact and another member is kept constant, chatter is hardly generated when the contact moves by the elastic deformation.

In the contact according to one or more embodiments of the present invention, a curved portion of the curved side surface constitutes a contact point. Accordingly, because the contact area of the contact point is reduced, the abrasion of the contact point decreases. Because the contact point becomes a line contact or a point contact, a contact pressure of the contact point increases to enhance a wiping effect.

In the contact according to one or more embodiments of the present invention, the contact may be prepared by electroforming. In the electroforming, compact-size contact including the curved portion can easily be prepared. In the contact, desirably a surface is curved so as to swell in a metallic deposit direction when the contact is prepared by the electroforming.

In a contact device according to one or more embodiments of the present invention in which the contact according to one or more embodiments of the present invention is accommodated in a contact housing member, the side surface of the contact is arranged so as to be in contact with a surface of a contact housing member placed so as to be parallel with the flat surface, the side surface of the contact being curved so as to swell, and the side surface slides while being in contact with the surface of the contact member when the contact is elastically deformed.

In the contact device according to one or more embodiments of the present invention, because at least the part of the side surface parallel to the surface in the direction in which the contact is elastically deformed is curved so as to swell, even if the side surface on the curved side is in contact with a contact accommodation vessel, the friction with the contact accommodation vessel can be reduced when the contact is elastically deformed, and the contact can smoothly elastically be deformed. Additionally, the contact is hardly abraded because the friction with the contact accommodation vessel is reduced when the contact is elastically deformed.

A contact manufacturing method according to one or more embodiments of the present invention includes the steps of: dipping a die including a recess corresponding to a shape of the contact in an electrolytic solution; and forming the contact by depositing metal in the recess by electroforming in the electrolytic solution. In the contact manufacturing method according to one or more embodiments of the present invention, a surface of the metal deposited in the recess of the die is curved so as to swell by adding an additive containing sulfur in the electrolytic solution.

The study of the inventors reveals that the surface of the metallic layer deposited in the recess is curved so as to swell using the sulfur containing additive added to the electrolytic solution.

The study of the inventors also reveals that a curvature of the surface of the metal deposited in the recess of the die is adjusted by changing an additive concentration in the electrolytic solution.

When the additive concentration is less than or equal to 0.01 g/liter (hereinafter referred to as g/L), the metallic deposit surface is coarsened in manufacturing the contact, and cannot be used as the contact. On the other hand, when the additive concentration of the electrolytic solution is greater than or equal to 0.1 g/L, the smoothly curved surface can be obtained.

In manufacturing the contact, a sulfur concentration of the electrolytic solution may be changed in order to adjust the curvature of the surface of the metal deposited in the recess of the die.

When the sulfur concentration is less than or equal to 0.0016 g/L, the metallic deposit surface is coarsened in manufacturing the contact, and cannot be used as the contact. On the other hand, when the sulfur concentration of the electrolytic solution is greater than or equal to 0.0156 g/L, the smoothly curved surface can be obtained.

In the contact manufacturing method, the contact includes an elastic deformation portion that is elongated when viewed from a direction perpendicular to the flat surface. In a section perpendicular to the direction in which the elastic deformation portion is elongated, assuming that D is a dimension in the direction parallel to the flat surface of the elastic deformation portion and that H is a dimension in the direction perpendicular to the flat surface of the elastic deformation portion, a curvature of the curved surface can be changed by changing an aspect ratio H/D of the section.

According to the experiments, when the aspect ratio H/D is less than or equal to 0.2, the recess is further generated in the swelling curved surface of the contact. On the other hand, when the aspect ratio H/D satisfies the following condition of $0.4 \leq H/D$ in the section perpendicular to the direction in which the elastic deformation portion is elongated, the smoothly curved surface can be obtained with no recess.

The above components may properly be combined, and many variations of the present invention can be made by the combination of the components.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

21 switch
22 contact
23 housing
24 sidewall
25 empty chamber
26 peripheral wall portion
27 first electrode
28 second electrode

29*a* meandering portion
29*b*, 29*c* extension portion
29*d*, 29*e* contact end portion
30*a*, 30*b* side surface
37 contact point
38 fitting hole
61 probe
62 contact
63 housing
63*a* housing body
63*b* cover
64 meandering portion
65 contact point portion
66 movable portion
69 empty chamber
81 contact
82 mother die
89 electrolytic bath
90 DC power supply
91 counter electrode
α electrolytic solution

The invention claimed is:

1. A contact comprising:

a flat first side surface having a width that is a first value;

a curved second side surface that is curved when viewed from a direction parallel to the flat first side surface, and that is disposed opposite the flat first side surface; and an elastic deformation portion that is elongated when viewed from a direction perpendicular to the flat first side surface, wherein a maximum thickness of the contact measured between the first side surface and the second side surface is a second value, wherein a ratio of the second value to the first value is equal to or greater than 0.4, wherein at least a part of the contact is able to be elastically deformed in parallel to the flat first side surface, and wherein at least part of the curved portion of the second side surface is located at the elastic deformation portion in a cross-section perpendicular to the direction in which the elastic deformation portion is elongated.

2. The contact according to claim 1, wherein the curved portion of the second side surface is continuously formed along the direction in which the elastic deformation portion is elongated.

3. The contact according to claim 1, wherein the curved portion of the second side surface constitutes a contact point.

4. A contact device comprising:

a contact housing member; and the contact according to claim 1 disposed in the contact housing member, wherein the second side surface of the contact is arranged so as to be in contact with a surface of the contact housing member placed so as to be parallel with the flat first side surface, and wherein the second side surface slides while being in contact with the surface of the contact housing member when the contact is elastically deformed.

* * * * *